US007032676B2

(12) United States Patent
Kulhanek et al.

(10) Patent No.: US 7,032,676 B2
(45) Date of Patent: Apr. 25, 2006

(54) WELL STRING INJECTION SYSTEM AND METHOD

(75) Inventors: Emanuel Kulhanek, Surrey (CA); Mark D. Widney, Adrossan (CA)

(73) Assignee: C-Tech Energy Services, Inc., Edmonton (CA)

( * ) Notice: Subject to any disclaimer, the term of this patent is extended or adjusted under 35 U.S.C. 154(b) by 0 days.

(21) Appl. No.: 10/423,826

(22) Filed: Apr. 24, 2003

(65) Prior Publication Data

US 2004/0020658 A1 Feb. 5, 2004

Related U.S. Application Data

(63) Continuation of application No. 09/898,679, filed on Jul. 3, 2001.

(30) Foreign Application Priority Data

Jun. 25, 2001 (CA) ..... 2351648

(51) Int. Cl.
*E21B 19/00* (2006.01)

(52) U.S. Cl. ..... 166/377; 166/378; 166/77.1; 166/77.3

(58) Field of Classification Search ..... 166/77.3, 166/77.2, 85.1, 385, 377, 378, 77.1
See application file for complete search history.

(56) References Cited

U.S. PATENT DOCUMENTS 3,285,485 A 11/1966 Slator
3,313,346 A 4/1967 Cross
3,373,818 A * 3/1968 Rike et al. ..... 166/77.3
3,559,905 A 2/1971 Palynchuk
4,515,220 A 5/1985 Sizer et al.
4,585,061 A 4/1986 Lyons, Jr. et al.
4,655,291 A 4/1987 Cox
5,094,340 A 3/1992 Avakov
5,133,405 A 7/1992 Elliston
5,188,174 A 2/1993 Anderson, Jr. et al.
5,309,990 A 5/1994 Lance
5,553,668 A 9/1996 Council et al. ..... 166/77.3
5,842,530 A * 12/1998 Smith et al. ..... 175/162

(Continued)

FOREIGN PATENT DOCUMENTS

CA 953644 8/1974

(Continued)

OTHER PUBLICATIONS

U.S. Appl. No. 09/898,679, filed Jul. 3, 2001, by Emanuel Kulhanek.*

(Continued)

*Primary Examiner*—David Bagnell
*Assistant Examiner*—Giovanna Collins

(57) ABSTRACT

A continuous feed injection unit used for example for injection and removal of continuous well string from wells operates in a dual speed configuration. The unit comprises a first hydraulic motor, a second hydraulic motor, cooperating continuous well string gripping chains connected to be driven by the first and second hydraulic motors, a hydraulic power supply connected to provide pressurized fluid to the first and second hydraulic motors and a control system for the hydraulic power supply. The control system for the hydraulic power supply has a motor speed control valve with at least a first and second operating configuration, the first operating configuration providing power fluid to the first and second hydraulic motors in parallel and the second operating configuration providing power fluid to the first and second hydraulic motors in series. The hydraulic power supply may be a conventional power tong hydraulic supply.

2 Claims, 3 Drawing Sheets

U.S. PATENT DOCUMENTS

| | | | | |
|---|---|---|---|---|
| 6,059,029 | A | 5/2000 | Goode | 166/77.3 |
| 6,276,449 | B1 * | 8/2001 | Newman | 166/53 |
| 6,332,501 | B1 * | 12/2001 | Gipson | 166/384 |

FOREIGN PATENT DOCUMENTS

| | | |
|---|---|---|
| CA | 1096850 | 3/1981 |
| CA | 1220418 | 4/1987 |
| CA | 1265998 | 2/1990 |

OTHER PUBLICATIONS

Design Engineers Handbook—Parker Hannifin Corporation, Cleveland OH—Bulletin 0224-B1 dated 1979 [2 pgs].

Industrial Fluid Power, Charles S. Hedges, Womack Educational Publication, Dallas TX, as early as 1988 [Chapter 5—select pp. 78, 80 ,82, 84, 86 and 88—Chapter 6, select pp. 102 and 104].

Copy of drawing marked Robishaw Engineering and titled Revised Hydraulic Circuit Corod Project 1301-048097B—alleged to show device in US for at least 15 years.

Copy of X-celerator information sheet distributed on Jun. 10, 2000 by C-tech Oilwell Technologies, Inc. at the Calgary Oil Show in Calgary, Alberta, Canada.

Copy of drawing marked Robishaw Engineering and titled HYD Circuit Corod 502 Project 1301-048098B.

Design Engineers Handbook Bulletin 0224-B1 (includes new 2nd sheet containing copyright information).

Sperry Vickers Mobile Hydraulics Manual M-2990-A, First Edition 1967, Second Edition 1979.

Industrial Fluid Power, vol. 3—Second Edition—includes the following new pp. 2, 81, 83, 85, 87, 89 and 103.

U.S. Deptartment of Labor Occupational Safety & Health Administration—www.osha.gov website Oil and Gas Well Drilling and Servicing eTool: Transporting Rig and Rigging Up (5 pages).

* cited by examiner

WELL STRING INJECTION SYSTEM AND METHOD

CROSS-REFERENCE TO RELATED APPLICATIONS

This application is a continuation of and claims the priority of an application entitled WELL STRING INJECTION SYSTEM AND METHOD, application Ser. No. 09/898,679 filed Jul. 3, 2001.

BACKGROUND OF THE INVENTION

This invention relates to devices used to manipulate continuous well strings for wellsite operations. Continuous well strings include rod, used for example to operate downhole pumps, and continuous tubing, used for example in a variety of downhole applications such as drilling and clean out operations. Continuous well strings are manipulated downhole typically with continuous chain injection units that include gripper pads for gripping the well strings. One early such design is shown in U.S. Pat. No. 3,559,905 of Palynchuk, issued Feb. 1, 1971, in which a continuous chain with gripping blocks carried by the chain is used to inject the well string into the well. More recently, such continuous chain gripper systems have been described in U.S. Pat. No. 5,553,668 of Council, et al, issued Sep. 10, 1996.

The continuous chain injection units when used at a rig conventionally are provided with their own hydraulic power supply, separate from the rig power supply and are supported over the well separately from the mast of a service rig. In addition, these conventional power supplies provide complicated ways of changing the speed of the motors. This invention provides an improvement on such power supplies and an improved method of locating a continuous chain injection unit over a well.

SUMMARY OF THE INVENTION

According to first aspect of the invention, there is provided a service rig, comprising a mast having a travelling block, a continuous well string injection unit suspended from the travelling block; and a hydraulic power supply for the continuous well string injection unit provided adjacent the mast. The continuous well string injection unit may comprise a first hydraulic motor, a return for hydraulic fluid used by the first hydraulic motor; and cooperating continuous well string gripping chains connected to be driven by the first hydraulic motor. The continuous feed injection unit may operate in a dual speed configuration. Such a dual speed unit may comprise a first hydraulic motor, a second hydraulic motor, cooperating continuous well string gripping chains connected to be driven by the first and second hydraulic motors, a hydraulic power supply connected to provide pressurized fluid to the first and second hydraulic motors and a control system for the hydraulic power supply.

According to a second aspect of the invention, the power tong supply of a service rig is used as the hydraulic power supply for the injection unit. The service rig comprises a mast, a hydraulic power supply for the power tongs provided adjacent the mast, a first hydraulic motor and preferably a second hydraulic motor mounted on the mast, a return for hydraulic fluid used by the first hydraulic motor and second hydraulic motor, cooperating continuous well string gripping chains connected to be driven by the first hydraulic motor and second hydraulic motor, the hydraulic power supply for the power tongs being connected to provide pressurized fluid to the first hydraulic motor and second hydraulic motor and a control system for the hydraulic power supply.

To provide for dual speed operation, the control system for the hydraulic power supply has a motor speed control valve with at least a first and second operating configuration, the first operating configuration providing power fluid to the first and second hydraulic motors in parallel and the second operating configuration providing power fluid to the first and second hydraulic motors in series.

According to a further aspect of the invention, for use in association with either the first or second aspects of the invention, the control system for the hydraulic power supply incorporates a motor direction control valve through which the power fluid flows, the motor direction control valve being configured to reverse flow of power fluid through the first and second hydraulic motors.

According to a further aspect of the invention, the continuous chains comprise a first continuous chain and a second continuous chain, the first continuous chain being driven by the first hydraulic motor and the second continuous chain being driven by the second hydraulic motor.

According to a further aspect of the invention, the control system for the hydraulic power supply having a motor direction control valve with at least a first, second and third operating configuration, the first operating configuration providing power fluid to the first hydraulic motor to lift well string from the well, the second operating configuration providing power fluid to the first hydraulic motor to inject well string into the well and the third operating configuration allowing power fluid to flow from the hydraulic power supply directly to the return.

The dual speed configuration allows the drill string to be pulled up slowly through viscous fluid, then when the drill string is free of viscous fluid, pulled rapidly to surface. The device has particular utility in heavy oil reservoirs. By using the power tong hydraulic fluid supply, expensive additional power supplies are not required and the injection unit is easily set up and removed with minimal inconvenience to the rig operator. These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

In this patent document, "comprising" means "including". In addition, a reference to an element by the indefinite article "a" does not exclude the possibility that more than one of the element is present. A valve as referred to herein need not be a single unit, but may be composed of several valve pieces. For example, the valves 36, 80 and 82 together constitute a single valve.

Figure 1:
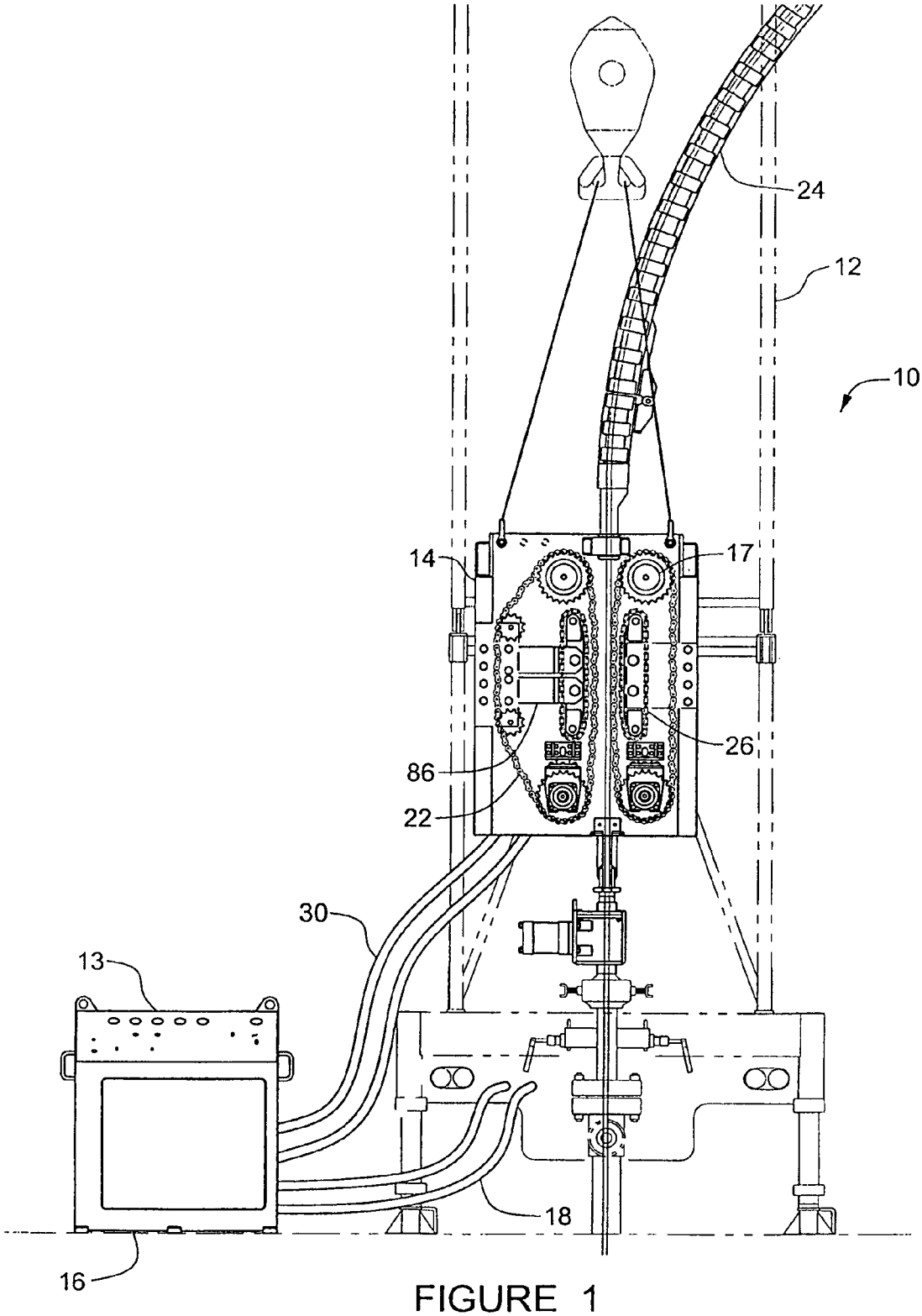
FIG. 1 shows a side view of a service rig with a continuous feed injection unit according to the invention.
Figure 1A:
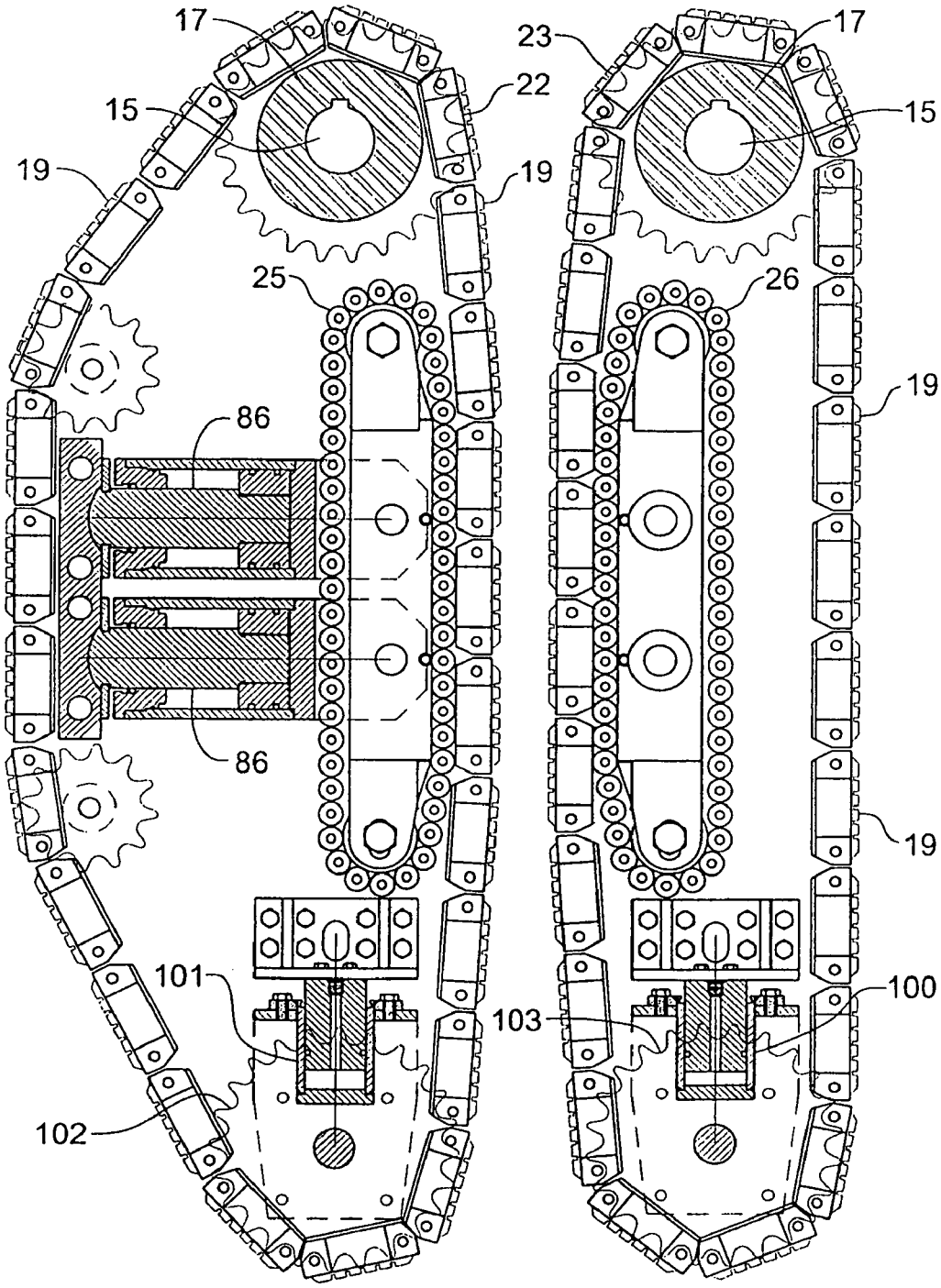
FIG. 1A shows a section through a continuous chain drive unit for use with the invention.

Referring to FIG. 1, there is shown a service rig 10 with a conventional mast 12 from which is suspended a continuous feed injection unit 14 by the travelling block 11. A hydraulic power supply 16 for conventional power tongs (not shown) are provided adjacent the mast 12. Tong hoses 18 lead out from the power supply 16 to the rig 10. The continuous feed injection unit 14, see particularly FIG. 1A, includes a pair of hydraulic motors 20, 21 (FIG. 2) and cooperating continuous chains 22, 23 connected to be driven by the hydraulic motors 20, 21 through shafts 15 of conventional gear reducers (not shown) and sprockets 17. The continuous chains 22, 23 include conventional gripper pads 19 for gripping continuous well string. The hydraulic power supply 16 for the power tongs is connected to provide pressurized fluid to the hydraulic motors 20, 21. A guide 24 provides continuous well string (not shown) from a conventional carousel (not shown) to the continuous chains 22, 23. Squeeze cylinders 86 squeeze the continuous chains 22, 23 between two free wheeling chain blocks 25, 26, by moving the chain block 25 laterally towards the fixed chain block 26. The chain block 25 is mounted on the cylinders 86. The squeeze cylinders preferably excerpt a high pressure in the order of 120,000 psi to grip and hold continuous rod. A lower pressure is used for coiled tubing. Chain tension cylinders 100, 101 are connected to sprockets 103, 102 respectively to maintain tension in the chain. The gripper blocks 19 and chains 22, 23 are conventional chains.

Figure 2:
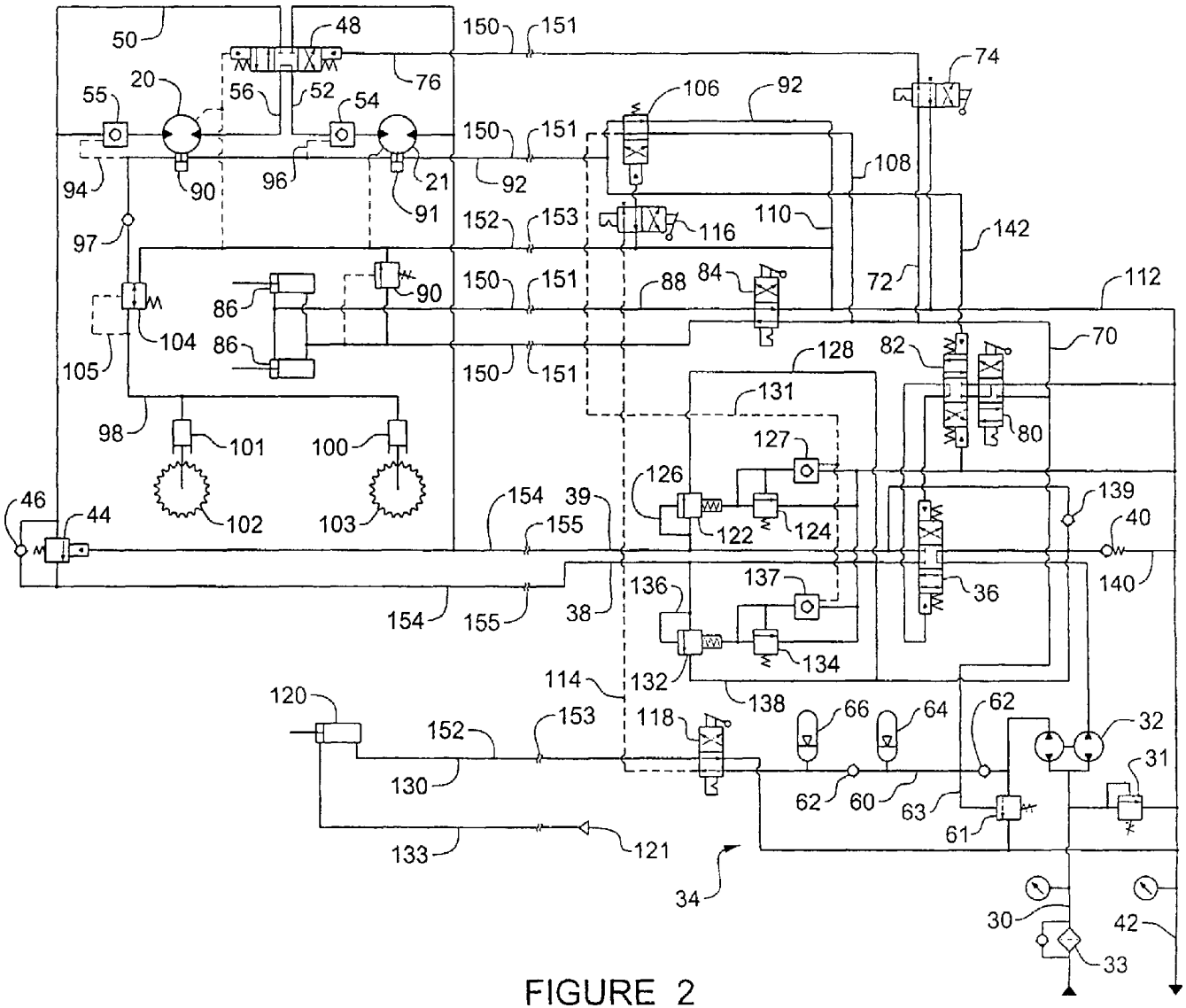
FIG. 2 is a schematic of a power supply for use with the continuous feed injection unit of FIG. 1.

Referring to FIG. 2, there is shown a control system 13 for the hydraulic power supply 16. Pressurized power fluid at for example 40 gpm and 2500 psi is supplied through line 30 and filter 33 to flow divider 32. A fraction for example 20% of the flow is diverted to auxiliary safety system 34. The remainder of the flow is direction to a directional control valve 36 which provides either straight through flow to lines 38, 39 or cross-over flow to reverse direction of fluid flow. Flow returns through check valve 40 to return 42. A pressure relief valve 31 is provided directly between the line 30 and return 42 to relieve excess pressure in the line 30.

In the case where fluid flow is straight through valve 36, which corresponds to the chains 22, 23 being operated to pull or lift well string from a well, the flow bypasses counterbalance valve 44 through check valve 46 and is provided directly to hydraulic motor 20. The power fluid is also provided to four way directional control valve 48, which controls flow to the hydraulic motors 20, 21 to govern the speed at which the motors 20, 21 operate. The control valve 48 functions as a motor speed control valve. In a first operating configuration, control valve 48 supplies fluid from line 50 to line 52 and then through valve 54 to motor 21, so that the motors 20, 21 operated in parallel. In a second operating configuration, directional valve 48 supplies power fluid that has passed through motor 20 along line 56 along line 52 through valve 54 to motor 21 so that the motors 20, 21 operate in series. In either case, the power fluid is returned through line 58 and check valve 40 to the return 42. Direction of movement of the motors 20, 21 is controlled by manually operated valve 80 and directional control valve 82, which control the control ports of directional valve 36, to set the directional valve 36 to the cross-over position, neutral position or straight through position. The valves 36, 80 and 82 function as a motor direction control valve.

Flow from flow divider 32 is directed along line 60 through check valves 62 to accumulators 64 and 66 in the auxiliary safety system 34. An unloading valve 61 is provided on the auxiliary line 60 to direct flow to the return 42 when high pressure is sensed on line 63. Line 60 provides control fluid through lines 70 and 72 to the control port 76 on directional control valve 48. Flow to the directional control valve 48 is controlled by manual operation of valve 74 on line 72. Fluid along line 70 is also provided under control of manual directional control valve 84 to squeeze cylinders 86, which provide the gripping force for the grippers on the chains 22, 23. To prevent damage from running oversized rod through the grippers, extra relief is provided on line 88 by relief valve 90.

Each of the motors 20, 21 is provided with a spring actuated brake 90, 91 respectively, which are held open by pressure in fluid line 92. Fluid line 92 also provides pressure to pilots 94, 96, which, when pressured, open the check valves 54 and 55 to allow power fluid from line 50 to power the motors.

Line 92 also supplies fluid through check valve 97 and line 98 to chain tension cylinders 100, 101. The chain tension cylinders 100, 101 engage sprockets 102, 103 respectively, which support the continuous chains 22, 23. A pressure relieving valve 104 is provided on line 98 to relieve excess fluid pressure sensed by pilot line 105, for example when the rod or tubing being moved snags on an obstacle. Excess pressure is relieved through line 107 connected to the fluid return 42 through lines 110 and 112. The pressure for the chain tension cylinders 100, 101 is preferably maintained at a relatively low level, for example 500 psi.

Fluid in line 92 is supplied via four way directional valve 106 from line 108, which is supplied fluid from the accumulators 64, 66, through line 70. The directional valve 106 is also connected through drain line 110 to drain fluid to the return 42. Directional control valve 106 is controlled by a pilot 114 that connects through two safety control valves 116 and 118 to the accumulators 64, 66. The control valve 116 functions as a parking brake.

Pressure to the motors is regulated by pilot operated pressure relief valves 122 and 132 connected respectively to the lines 39, 38. The relief pressure is set by remote pressure controls 124, 134. When pressure in lines 39, 38 exceeds a pressure set by controls 124, 134 respectively, lines 126, 136 sense the pressure and open valves 122, 132 respectively to drain fluid through lines 128, 138, check valve 139 and line 140 to the return 42. When the parking brake is on, pressure in line 131 opens the check valves 127, 137, and vents the pilots on the valves 122, 124, 132 and 134 to drain, thus setting the valves 122, 132 to drain at zero pressure and disabling the motors 20, 21. Valve 118 is a main safety valve. When valve 118 is manually operated to the cross-over position, safety brake cylinder 120 is actuated by fluid through line 130 to stop the chains 22, 23. The safety brake cylinder 120 remains activated until released by 100 psi pressure from source 121 through hose 133.

The manner in which the hydraulic control system works will now be described. When the system is hooked up to the tong power lines 30, the valve 36 is set at neutral and fluid runs back through line 140 to the return 42. Valve 82 is also in the neutral position initially.

To grip rod with the gripping blocks 23, valve 84 is set to the cross-over position, which forces the movable chain block 25 laterally towards chain block 26 and grip rod or tubing between the chains 22, 23.

To power the motors, the parking brake 116 is released and the main safety valve 118 is placed in the cross-over position to allow pilot line 114 to activate valve 106. Valve 106 moves into the cross-over position and power fluid supplied through lines 70 and 108 is provided to lines 92 and 142. Fluid in line 92 releases the brakes 90, 91 on the motors 20,21, opens the check valves 54, 55 to allow power fluid to allow power fluid in line 50 to activate the motors 20, 21 and powers the chain tensioners 100, 101 through line 98. Fluid in line 142 activates valve 82 into the straight through position.

The speed setting of the tool is selected by valve 74 as follows. The straight through position provides power fluid in line 70 through line 72 to actuate valve 76 to the cross-over position, which forces the motors 20, 21 to operate in parallel, thus providing low speed, high pressure. The cross-over position of valve 74 allows fluid in line 72 to drain to the return 42 through line 112, and the valve 76 resets to the neutral position which forces the motors 20, 21 to operate in series, thus providing a high speed, low pressure operation of the motors 20, 21.

When the operator is sure the rod or tubing is gripped, and the brakes are off, valve 80 is manually operated to select up or down motion for the motors. In the cross-over position, fluid in line 70 forces valve 36 into the straight through position. Power fluid then flows through line 38 and line 50 to the motors 20, 21, which will be operating in high speed or low speed depending on the selection of valve 74. The motors 20, 21 will be operating in the upward, pulling direction. When it is desired to lower rod into the well, valve 80 is set to the straight through position, which sets valve 36 into the cross-over position. Power fluid then is supplied through line 39 to counterbalance valve 39, and opens it to allow fluid to drain through lines 38 and 142 to the return. At the same time, fluid from line 39 is provided along line 58 to power the motors 20, 21 in either high speed or low speed operation depending on the position of valve 74. Counterbalance valve 44 places a drag on the motors 20, 21 to prevent them from overrunning due to the weight of the rod or tubing.

Operation of the valve 80 is used to shut off the motors if desired. The main safety valve 118 may also be operated to engage the stop cylinder 120 (which squeezes the rod to stop it), engage the brakes 90, 91 on the motors 20, 21, and activate the check valves 54, 55 to prevent the motors 20, 21 from operating.

The continuous gripper chain unit as well as the motors 20, 21, and cylinders 86, 100, 101 are mounted on the well, while the controls (right side of FIG. 2) are mounted in a separate unit about 30 ft away. Conventional hoses 150, 152 and 154, with quick couplings 151, 153 and 155 may be used to connect the units.

In this way, the continuous feed injection unit of the present invention may be operated using the power tong hydraulic power supply of a conventional rig, and may be readily operated in a high speed, low pressure configuration when the well string is held by viscous fluid and a low speed, high pressure configuration when well string is free of viscous fluid.

Parts for the control system may be obtained as follows:

| Item | Description | Source | Part No. |
|---|---|---|---|
| 36, 48 | 4-way directional control valve | Rexroth | 4WH22G7X |
| 106 | 4-way directional valve | Rexroth | 4WH6D5X |
| 74, 116, 84 | 4-way directional control valve | Rexroth | 4WMM6D5X/F |
| 118 | 4-way directional control valve | Rexroth | 4WMM1003X/F |
| 54, 55 | Pilot check valve | Sun | CKGB-XCN-HCM |
| 127, 137 | Pilot check valve | Sun | CKCB-XCN-ECJ |
| 62, 139 | Check Valve (T-5A CAVITY) | Sun | CXFA-XAN-DAK |
| 40 | 50 PSI Check Valve (T-16A CAVITY) | Sun | CXHA-XDN-IAN |
| 122, 132 | Pressure Relief Valve (T-17A CAVITY) | Sun | RVGA-LAN-HCM |
| 124 | Remote Pressure Control | Sun | RBAC-KBN-FAJ |
| 134 | Remote Pressure Control | Sun | RBAC-KAN-FAJ |
| 44 | Counterbalance Valve | Sun | CBGG-LJN-HCM |
| 31 | Pressure Relief Valve | Sun | RDFA-LAN-CAL |
| 61 | Unloading Valve | Denison | R4U06-503-12*1 |
| 104 | Pressure Reducing/Relieving Valve | Sun | PPFB-LAN-BAL |
| 64, 66 | 2.5 gallon Accumulator | Accumulators Inc. | A-2.5-3100L |
| 26, 21 | Hydraulic Motor | Permco | M7500A767ADNE20-6 |
| 90, 91 | Brake | Eskridge | 75C-4-C-4-B068-D |
| — | Gear Reducer (not shown) | Heco | 20DGF-11-6-31-1 |
| 97 | Inline Check Valve | Parker | C820-S |
| 90 | Pressure Relief Valve | Sun | RPEC-KAN-FAJ |
| 86 | Squeeze Cylinders | C-TECH | MK1 G625D109 |
| 100, 101 | Chain Tensioner Cylinders | C-TECH | MK1 G625D117 |
| 120 | 6" Safety Cylinder | Yates | H6M-N6.OP-3.00N2.50TXS11 |
| 32 | 20/80 Gear Type Flow Divider | Control Flow | FD5088YAD25-1GED07-1BY |
| 80 | 4-way directional control valve | Rexroth | 4WMM6J5X/F |
| 150 | 3/8" HOSE-30 FT-06NPTM/08JICF | Greenline | G122R-06M68FJ30 |
| 151 | Quick Coupling | Greenline | C701H/702H-06 |
| 152 | ½" HOSE-30 FT-08NPTM/12JICF | Greenline | G122R-08M812FJ30 |
| 153 | Quick Coupling | Greenline | C701H/702H-08 |
| 154 | ¾" HOSE-30 FT-12NPTM/16JICF | Greenline | G122R-12M1216FJ30 |
| 155 | Quick Coupling | Greenline | C701H/702H-12 |
| 82 | 4-way directional control valve | Rexroth | 4WH6G5X/S0135 |
| 33 | High Pressure Filter | Stauff | 5F045G208-TU/BAT |
| 133 | ¼" 250 PSI Pneumatic Hose-30 FT. | Greenline | G222-025M66M30 |

Immaterial modifications may be made to the invention described here without ting from the essence of the invention. For example, one or more additional motors e used in parallel and in series.

What is claimed is:

1. A method of pulling well string from a well penetrating a heavy oil reservoir, the method comprising the steps of:

pulling well string through heavy oil using at least two motors in parallel; and when the well string is free of the heavy oil, pulling the well string using the two motors in series to pull the well string more rapidly from the well than the well string was pulled through the heavy oil.

2. The method of claim 1 in which the two motors are powered by a power tong hydraulic power supply of a service rig.

* * * * *